US005484024A

United States Patent [19]

Ladd et al.

[11] Patent Number: 5,484,024

[45] Date of Patent: Jan. 16, 1996

[54] OILWELL SPILL CONTAINMENT

[76] Inventors: Douglas Ladd, 2536 Mary Ellen St, Pampa, Tex. 79065-3007; John K. Quirk, P.O. Box 1277, Fritch, Tex. 79036

[21] Appl. No.: 368,035

[22] Filed: Jan. 3, 1995

[51] Int. Cl.[6] ..... E21B 33/08

[52] U.S. Cl. ..... 166/369; 166/379

[58] Field of Search ..... 166/81, 84, 93, 166/369, 379

[56] References Cited

U.S. PATENT DOCUMENTS

| | | | |
|---|---|---|---|
| 2,137,853 | 11/1938 | Nixon | 166/84 X |
| 2,869,469 | 1/1959 | Williams | 166/84 X |
| 3,270,810 | 9/1966 | Johnston | 166/84 |
| 3,353,606 | 11/1967 | Dyer | 166/84 |
| 3,662,829 | 5/1972 | Gault et al. | 166/84 |
| 4,949,784 | 8/1990 | Evans | 166/81 |
| 4,951,743 | 8/1990 | Henderson | 166/84 |
| 5,150,751 | 9/1992 | Burton et al. | 166/81 |
| 5,394,939 | 3/1995 | Walker | 166/81 |

OTHER PUBLICATIONS

Messtopper Cone, Inc—"Flyer" Date: Before Appl. Invent.
Hasco Invironmental Safety Seal Liner Hasco Mfg., Co. Sapulpa Okla. Before Appl Invent.

*Primary Examiner*—Stephen J. Novosad
*Attorney, Agent, or Firm*—Wendell Coffee

[57] ABSTRACT

An expandable and contractible covering is over the polished rod and the polished rod liner from above the polished rod liner clamp to below the stuffing box. This covering protects the environment in the event of failure of the liner or stuffing box. The covering may be quickly released from a basin below the stuffing box and contracted upward to service the stuffing box. The basin is connected to a special fitting between the stuffing box and pumping tee.

16 Claims, 3 Drawing Sheets

OILWELL SPILL CONTAINMENT

CROSS REFERENCE TO RELATED APPLICATION

None, however, Applicant filed Disclosure Document Number 362454 on Sep. 29, 1994, which document concerns this application; therefore, by separate paper it is respectfully requested that the document be retained and acknowledgment thereof made by the Examiner. (MoPEP 1706)

BACKGROUND OF THE INVENTION (1) Field of the Invention

This invention relates to oil wells, and more particularly to the prevention of environmental damage caused by the leakage of well fluid from above the pumping tee of an oil well due to failure of the polished rod liner or stuffing box. Persons engaged in oil well production have ordinary skill in the art.

(2) Description of Related Art

Oil wells often have a pump jack to reciprocate a sucker rod. The sucker rod operates a reciprocating pump at the bottom of the well. Bridle cables are attached to the pump jack. The bridle cables extends to a bridle. A polished rod is connected at the bridle. At the other end of the polished rod, the polished rod is connected to the sucker rod.

The polished rod passes through a stuffing box and into an eduction tube at the well head. Oil and other well fluids are pumped up through the eduction tube. The stuffing box prevents the fluids from flowing out of the eduction tube and onto the ground.

A polished rod liner is used to protect the polished rod. The polished rod liner surrounds the polished rod and is attached by a polished rod liner clamp to the polished rod. The polished rod liner is attached to the polished rod below the bridle. The polished rod liner clamp includes a seal between the polished rod liner and the polished rod. Well fluid will be between the polished rod liner and the polished rod. The polished rod liner is a thin tube of steel that has a particularly smooth outside surface so that a non-leaking, low friction seal is maintained between the polished rod liner and the stuffing box.

The polished rod liner can fail for a number of reasons. Among the reasons for polished rod liner failure are metal fatigue due to the reciprocation of the polished rod, misalignment between the polished rod liner and the stuffing box, and failure due to corrosion of the polished rod liner due to impurities in the produced well fluids. When the polished rod liner fails, well fluid is permitted to flow or spray from the polished rod liner. The result of failure of the polished rod liner is an environmental spill in the area surrounding the well.

The term "oil well" is used in this application to include salt water wells or gas well or any of the fluid pumping well operated by a reciprocating rod which might pollute the environment.

SUMMARY OF THE INVENTION (1) Progressive contribution to the art

We have invented a leak container for an oil well using a reciprocating rod and rod liner which passes through a stuffing box. The leak container includes a containment basin and a covering. The containment basin surrounds a stuffing box located on the pumping tee. The bottom of the covering attaches to the containment basin. The top of the covering attaches to the reciprocating polished rod. The covering attaches to the polished rod above a polished rod liner, but below the bridle. The covering telescopes to expand and contract as the polished rod is reciprocated.

The leak container is able to prevent damage to the environment caused by failure at the polish rod liner. Also, the leak container prevents environmental damage resulting from the failure of the stuffing box.

(2) Objects of this invention

A goal and object of this invention is to prevent environmental damage to an area surrounding an oil well when a polished rod liner or a stuffing box fails.

A further object of this invention is to protect the polished rod liner and stuffing box from dust and dirt.

A further object of this invention is to protect the polished rod liner from adverse weather conditions.

Further objects and goals are to achieve the above with a device which is sturdy, compact, durable, light-weight, simple, safe, efficient, versatile, ecologically compatible, energy conserving and reliable; yet is inexpensive and easy to manufacture, install, and maintain.

Other objects and goals are to achieve the above with a method that is rapid, versatile, ecologically compatible, energy conserving, efficient, inexpensive, and does not require highly skilled people to install and maintain.

The specific nature of the invention, as well as other objects, uses, and advantages thereof, will clearly appear from the following description and from the accompanying drawings, the different views of which are not necessarily scale drawings.

Figure 1:
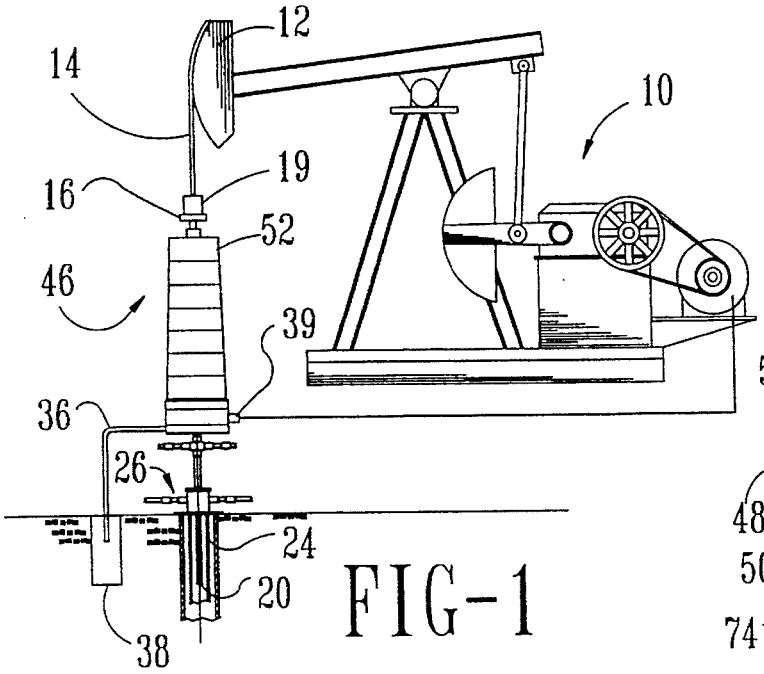
FIG. 1 is a representation of a pumping oilwell according to this invention.

As an aid to correlating the terms of the claims to the exemplary drawings the following catalogue of elements and steps is provided:

10 pump jack
12 horse head
14 bridle cables
16 bridle
18 polished rod
19 polished rod clamp
20 sucker rod
22 stuffing box
23 pumping tee
24 eduction tube
26 wellhead
28 outlet piping
30 polished rod liner
32 polished rod liner clamp
34 basin

36 drain
38 sump
39 sensor
40 service ring
42 ledge
44 cover support
46 covering
48 cover segments
50 bottommost segment
52 uppermost segment
54 inward turned flange
56 outward turned flange
58 outer ring
59 inner ring
60 spokes
61 spoke support
62 spacer ring
64 perforated cover
66 cover top
68 cover clamp
70 set screws
72 service hooks
74 service eyes
75 special fitting
76 special flange
78 opening
80 bottom mount plate
82 top mount plate
84 bolts

DESCRIPTION OF THE PREFERRED EMBODIMENTS

FIG. 1 shows a common reciprocating rod pumping unit. Pump jack 10 includes horse head 12. Bridle cables 14 extends from the horse head to bridle 16. Polished rod 18 extends through the bridle. The polished rod is held above the bridle by polished rod clamp 19. The polished rod is attached to sucker rod 20 at the opposite end of the polished rod.

The polished rod 18 passes through stuffing box 22 into eduction tube 24 at pumping tee 23 above wellhead 26. Well fluid is pumped up through the eduction tube to outlet piping 28 located below the stuffing box. The stuffing box prevents well fluid from flowing out the eduction tube and onto the ground.

Polished rod liner 30 surrounds the polished rod 18. The polished rod liner is a thin tube of steel that has a smooth outside surface. The smooth surface helps maintain a low friction, non-leaking seal between the polished rod liner and the stuffing box 22.

The polished rod liner 30 attaches to the polished rod 18 by polished rod liner clamp 32. The polished rod liner is attached to the polished rod below the bridle 16.

Figure 3:
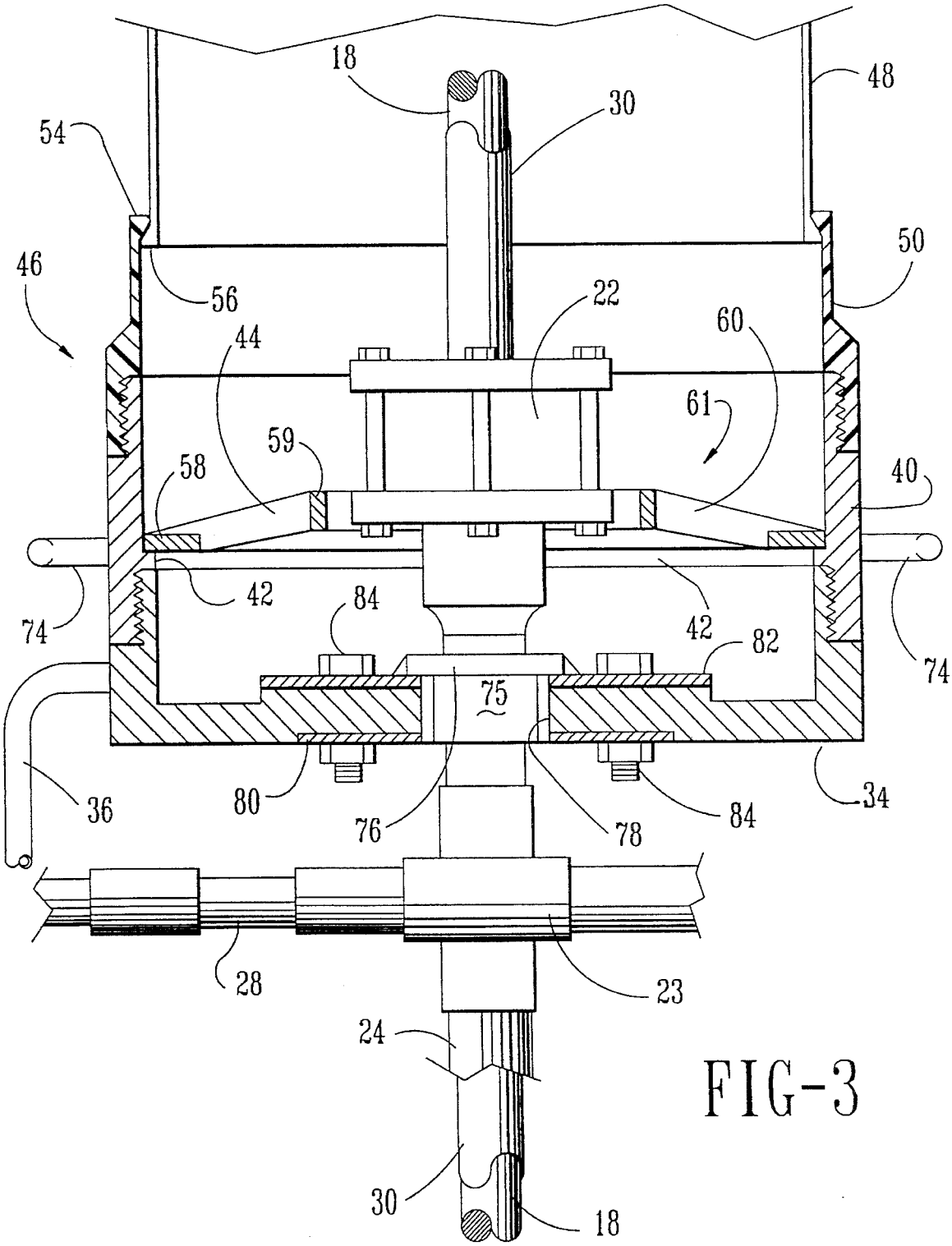
FIG. 3 is a cross-sectional detail of the attachment of the basin and the bottom of the cover to the pumping tee surrounding the stuffing box.

As shown in FIG. 3, basin 34 is connected to the pumping tee 23 around the stuffing box 22. The basin collects any fluid that leaks from a broken polished rod liner 30 or from the stuffing box. The basin may be provided with drain 36 to remote container or sump 38. The basin and remote container together form a waste collector. Also, either the basin or the sump can be equipped with sensor 39 which will turn off the pumping unit if too much fluid is leaking into the basin.

Service ring 40 is threaded or clamped to the top of the basin 34. The service ring has ledge 42 for supporting the outside edge of cover support 44.

Expandable covering 46 attaches to the top of the service ring 40. The expandable covering has a plurality of cylindrical telescoping rigid segments 48. Each segment has approximately the same length. The bottommost segment 50 is threaded to the service ring. The segments 48 are preferably made of molded synthetic composite material made of plastic.

Uppermost segment 52 has the smallest diameter, and each subsequent segment has a slightly larger diameter. The top of each segment has an inward turned flange 54. The bottom of each segment has an outward turned flange 56, except for the bottommost segment 50 which is threaded on the bottom to join with the service ring 40. The flanges prevent the telescoping covering 46 from coming apart when the covering expands. The covering expands and contracts as the polished rod 18 is reciprocated.

The cover support 44 supports the bottom ends of the cover segments 48 when the covering is not expanded. The covering support allows drainage from the covering 46 and cover segments 48 into the basin 34. One embodiment of the support 44 has outer ring 58 and inner ring 59. In webbed or spoke cover support 61 the outer ring 58 rests on the ledge 42 formed by the service ring 40. A plurality of webs or spokes 60 are located between the inner and outer rings 58 and 59 to provide structural strength. The webbed or spoke support 44 is shown in FIG. 3.

Figure 4:
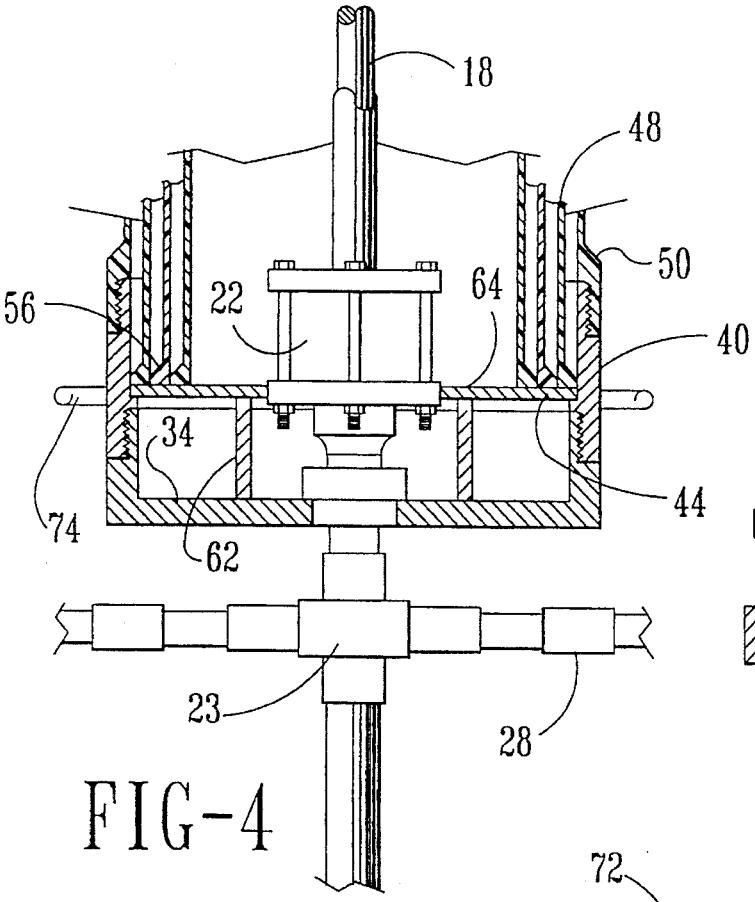
FIG. 4 is similar to FIG. 3 showing a second embodiment of the basin support, with cover segments resting thereon.

Also, the cover support could be in the form of spacer ring 62 which is placed in the bottom of the basin 34, on top of which is placed perforated cover 64, as is shown in FIG. 4. The cover segments 48 are shown resting on the perforated cover 64.

Figure 2:
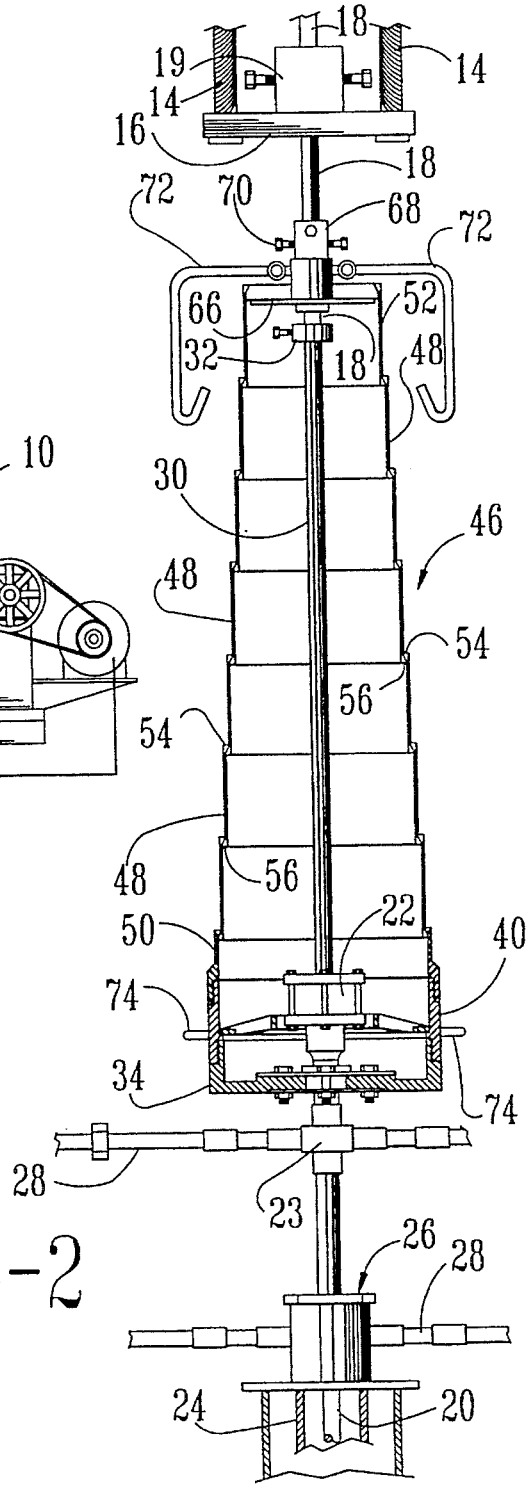
FIG. 2 is a sectional view of the polished rod liner cover according to this invention on the well head.
Figure 5:
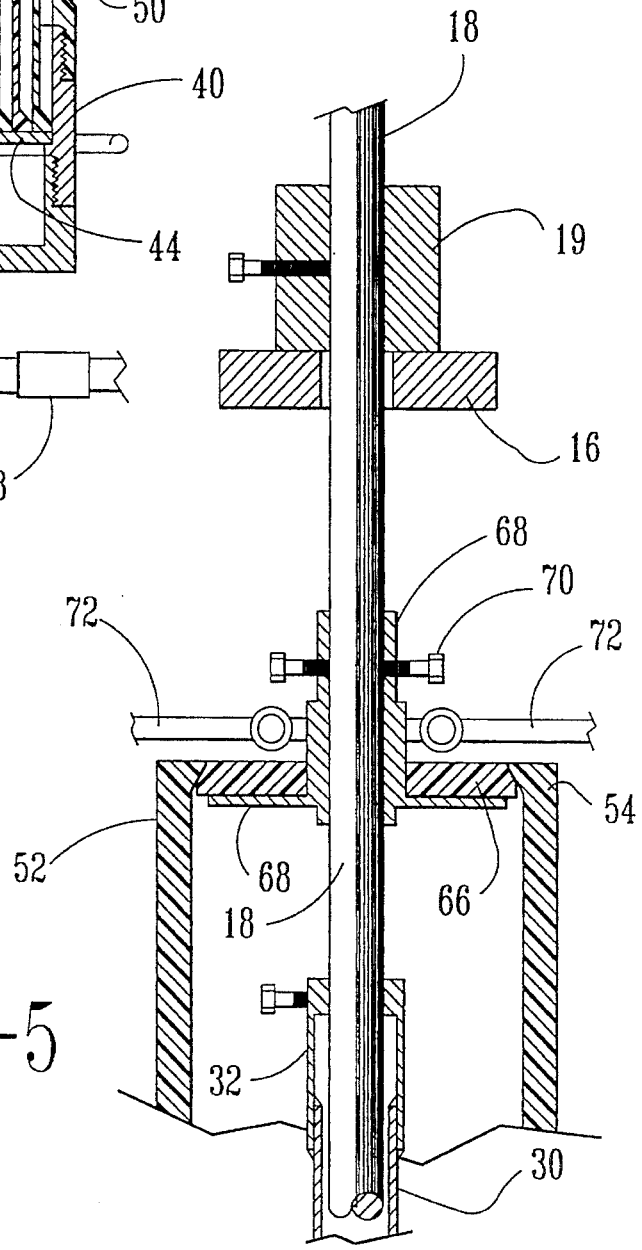
FIG. 5 is a sectional detail of the attachment of the top of the cover to the polished rod.

As shown in FIGS. 2 and 5, the uppermost cover segment 52 rests on cover top 66. The cover top rests on cover clamp 68. The cover clamp attaches to the polished rod 18 by set screws 70. The cover clamp is attached to the polished rod below the bridle 16, but above the polished rod liner clamp 32.

In the event the movement of the polished rod is less than maximum it would not be necessary to use a maximum number of the cover segments 48. In that event the top segment could be eliminated and the segment immediately below it be in that event the top segment. Also, in that event it would be necessary to use a larger cover top 66. It will be noted that the cover top 66 has flanges which mate with the uppermost or inward turned flange 54 of the uppermost segment 52.

Therefore, at any time a stroke of the existing pump jack 10 did not require the maximum length of the covering 46 the number of segments could be reduced so that the maximum stroke of the pump jack would be accommodated. The only change to be made, besides the elimination of individual segments 48, would be the provision of a properly sized cover top 66. Stated otherwise, by the availability of a cover top 66 which would mate with the inward turned flange 54 of each segment the range of stroke of the pump jack 10 could be varied over the full range from the minimum to the maximum.

Easy access to the stuffing box 22 and the polished rod liner 30 is obtained with service hooks 72, located on the cover clamp 68, and service eyes 74, located on the service ring 40. To provide such access, the service ring is disconnected from the basin 34. The polished rod 18 is lowered to place the covering 46 in a compressed arrangement. The service hooks are connected to the service eyes. Then, the polished rod is raised. This will move by raising the covering and provide access to the stuffing box and the polished rod liner.

The basin 34 may be attached above the pumping tee 23 in many fashions. FIG. 4 does not illustrate any details of this attachment. The preferred attachment of basin 34 to the pumping tee 23 is shown in FIG. 3.

As seen in FIG. 3 special fitting 75 screws into pumping tee 23. The special fitting is basically a nipple with integral special flange 76 coaxially surrounding the nipple. Top mount plate 82 is welded to the top of the special flange, coaxially therewith. The basin 34 has a central circular opening 78 which fits around the special fitting 75. The upper surface of the bottom of the basin seals to the lower surface of the top mount plate 82.

A plurality of bolts 84 extend through matched holes in bottom mount plate 80, the basin 34, and the top mount plate 82. The bottom mount plate fits in a depression in the bottom of the basin. When tightened, the bolts 84 will clamp the basin to the special fitting.

The stuffing box 22 screws into the top of the special fitting.

The embodiments shown and described above are only exemplary. We do not claim to have invented all the parts, elements, or steps described. Various modifications can be made in the construction, material, arrangement, and operation, and still be within the scope of our invention.

The restrictive description and drawings of the specific examples above do not point out what an infringement of this patent would be, but are to enable one skilled in the art to make and use the invention. The limits of the invention and the bounds of the patent protection are measured by and defined in the following claims.

We claim as our invention:

1. The method of protecting an area surrounding a wellhead from environmental damage resulting from liquid discharge from an oil well comprising:

a) attaching a top end of an expandable covering to a polish rod above the polish rod liner clamp;

b) attaching a bottom end of the expandable covering to a containment basin, said basin surrounding a stuffing box; and c) expanding and contracting the expandable covering as the polish rod is reciprocated, and d) servicing the stuffing box by e) detaching the bottom end of the expandable cover from the basin, and f) moving the bottom end of the expandable covering while the top end is still attached to a polish rod.

2. The method of protecting an area surrounding an oil well as defined in claim 1 further comprising:

g) guiding any released liquid from the oil well to the containment basin; and h) automatically turning off a pump jack when excessive liquid has been released.

3. The method of protecting an area surrounding an oil well as defined in claim 1 further comprising:

g) draining any released liquid from the containment basin to a remote container.

4. A leak container for an oil well using a polished rod liner connected by a polished rod liner clamp to a polished rod which passes through a stuffing box comprising:

a) a basin connected to the oil well around the stuffing box on a wellhead;

b) an expandable covering having a bottom end and a top end, c) said bottom end of the expandable covering connected to the basin;

d) a cover top supporting the top end of the expandable covering, e) a cover clamp supporting the cover top, said cover clamp attached to the polished rod above the polished rod liner clamp, f) the expandable covering connects to the basin by means for easy removal of the expandable covering from the basin, and g) means for moving the expandable covering to provide access to the stuffing box.

5. The oilwell leak container as defined in claim 4 further comprising:

h) a special fitting connected below the stuffing box, i) a special flange on the special fitting, j) a top mount plate welded to the special flange, k) said basin contacting the lower side of the top mount plate, l) a bottom mount plate contacting the lower side of the basin, and m) bolts extending through the bottom mount plate, basin, and the top mount plate.

6. The oil well leak container as defined in claim 4 wherein the expandable covering comprises:

h) a plurality of cylindrical telescoping rigid segments, each segment having a top and a bottom;

i) an uppermost segment having a smallest diameter, with each subsequent segment having a slightly larger diameter;

j) a bottommost segment connected to the basin;

k) the top of each segment having an inward turned flange;

l) the bottom of each segment having an outward turned flange; and m) each segment having approximately the same length.

7. The oil well leak container as defined in claim 6 further comprising:

n) a means-for supporting the bottom ends of the expandable covering segments, said means connected to the basin so that the bottom of each segment rests on said means when the expandable covering is in a compressed arrangement.

8. The oil well leak container as defined in claim 4 further comprising:

h) a drain from the basin to a waste container which together form a waste collector; and i) a level sensor attached to the waste collector which shuts off a pump jack when activated.

9. The oilwell leak container as defined in claim 4 further comprising:

h) said means for easy removal is in the form of a service ring, and i) said means for moving includes service eyes on the service ring.

10. A leak container for an oil well using a polished rod liner connected by a polished rod liner clamp to a polished rod which passes through a stuffing box comprising:

a) a basin connected to the oil well around the stuffing box on a wellhead;

b) an expandable covering having a bottom end and a top end, c) said bottom end of the expandable covering connected to the basin;

d) a cover top supporting the top end of the expandable covering, e) a cover clamp supporting the cover top, said cover clamp attached to the polished rod above the polished rod liner clamp.

f) a special fitting connected below the stuffing box, g) a special flange on the special fitting, h) a top mount plate welded to the special flange, i) said basin contacting the lower side of the top mount plate, j) a bottom mount plate contacting the lower side of the basin, and k) bolts extending through the bottom mount plate, basin, and the top mount plate.

11. The oil well leak container as defined in claim 10 wherein the expandable covering comprises:

l) a plurality of cylindrical telescoping rigid segments, each segment having a top and a bottom;

m) an uppermost segment having a smallest diameter, with each subsequent segment having a slightly larger diameter;

n) a bottommost segment connected to the basin;

o) the top of each segment having an inward turned flange;

p) the bottom of each segment having an outward turned flange; and q) each segment having approximately the same length.

12. The oil well leak container as defined in claim 11 further comprising:

r) a means for supporting the bottom ends of the expandable covering segments, said means connected to the basin so that the bottom of each segment rests on said means when the expandable covering is in a compressed arrangement.

13. The oil well leak container as defined in claim 10 further comprising:

l) a drain from the basin to a waste container which together form a waste collector; and m) a level sensor attached to the waste collector which shuts off a pump jack when activated.

14. The oilwell leak container as defined in claim 10 further comprising:

l) said means for easy removal is in the form of a service ring, and m) said means for moving includes service eyes on the service ring.

15. A leak container for an oil well using a polished rod liner connected by a polished rod liner clamp to a polished rod which passes through a stuffing box comprising:

a) a basin connected to the oil well around the stuffing box on a wellhead;

b) an expandable rigid covering having a bottom end and a top end, c) said bottom end of the expandable covering connected to the basin;

d) a cover surrounding the top end of the expandable covering, e) a cover clamp supporting the cover top, said cover clamp attached to the polished rod above the polished rod liner clamp, f) a plurality of cylindrical telescoping rigid segments, each segment having a top and a bottom;

g) an uppermost segment having a smallest diameter, with each subsequent segment having a slightly larger diameter;

h) a bottommost segment connected to the basin;

i) the top of each segment having an inward turned flange;

j) the bottom of each segment having an outward turned flange;

k) each segment having approximately the same length;

l) a means for supporting the bottom ends of the expandable covering segments, said means connected to the basin so that the bottom of each segment rests on said means when the expandable covering is in a compressed arrangement, m) the expandable covering connects to the basin by means for easy removal of the expandable covering from the basin, n) means for lifting the expandable covering when the expandable covering is in a compressed arrangement to provide access to the polished rod liner and stuffing box;

o) a drain from the basin to a remote container together forming a waste collector; and p) a level sensor attached to the waste collector which shuts off the pump jack when activated.

16. The oilwell leak container as defined in claim 15 further comprising said basin attached around the stuffing box by means of a top plate above and a bottom plate below a central opening in the basin, said top plate welded to a flange connected above the pumping tee immediately below the stuffing box.

* * * * *